US006431702B2

(12) United States Patent
Ruhe

(10) Patent No.: US 6,431,702 B2
(45) **Date of Patent: *Aug. 13, 2002**

(54) APPARATUS AND METHOD USING ULTRASONIC ENERGY TO FIX INK TO PRINT MEDIA

(75) Inventor: Thomas W. Ruhe, La Center, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 10 days.

This patent is subject to a terminal disclaimer.

(21) Appl. No.: 09/739,921

(22) Filed: Dec. 18, 2000

Related U.S. Application Data

(63) Continuation of application No. 09/327,701, filed on Jun. 8, 1999.

(51) Int. Cl.[7] ..... B41J 2/01; B41J 2/165
(52) U.S. Cl. ..... 347/102; 347/34
(58) Field of Search ..... 347/34, 102

(56) References Cited

U.S. PATENT DOCUMENTS

| | | | | |
|---|---|---|---|---|
| 4,046,073 | A | 9/1977 | Mitchell et al. | 101/489 |
| 4,370,662 | A | 1/1983 | Hou et al. | 347/75 |
| 4,434,430 | A | 2/1984 | Koto | 347/70 |
| 4,600,928 | A | 7/1986 | Braun et al. | 347/27 |
| 4,728,963 | A | 3/1988 | Rasmussen et al. | 347/102 |
| 4,729,175 | A | 3/1988 | Beard et al. | 34/246 |
| 4,849,769 | A | 7/1989 | Dressler | 347/27 |
| 4,970,528 | A | 11/1990 | Beaufort et al. | 347/102 |
| 5,171,387 | A | 12/1992 | Wuchinich | 156/73.3 |
| 5,220,346 | A | 6/1993 | Carreira et al. | 347/102 |
| 5,339,147 | A | 8/1994 | Snelling et al. | 399/333 |
| 5,390,013 | A | 2/1995 | Snelling | 399/328 |
| 5,410,283 | A | 4/1995 | Gooray et al. | 333/159 |
| 5,414,453 | A | 5/1995 | Rhoads et al. | 347/8 |
| 5,422,463 | A | 6/1995 | Gooray et al. | 219/694 |

(List continued on next page.)

FOREIGN PATENT DOCUMENTS

| | | | | |
|---|---|---|---|---|
| JP | 63155392 | * | 1/1990 | B41J/2/01 |
| JP | 03019843 | * | 9/1992 | B41J/2/016 |

OTHER PUBLICATIONS

"Drying By Airborne Ultrasonics;" pp. 8, 9 and 14–16; R.M.G. Boucher; Ultrasonic News, Second Quarter, 1959.

*Primary Examiner*—John Barlow
*Assistant Examiner*—Alfred Dudding
(74) *Attorney, Agent, or Firm*—Erik A. Anderson

(57) ABSTRACT

An inkjet printing method of fixing ink to a print medium is disclosed. An embodiment of the method comprises depositing ink drops on a print medium with an inkjet printhead, the ink including a solvent and the print medium including a first surface. The method additionally comprises vibrating the print medium by applying ultrasonic energy to displace drops of the solvent to the first surface of the print medium to accelerate evaporation of the drops of solvent. An apparatus for use in an inkjet printing device is also disclosed. An embodiment of the apparatus comprises an ultrasonic source configured to apply ultrasonic energy to a print medium to displace drops of ink solvent to a first surface of the print medium thereby accelerating evaporation of the drops of solvent. An inkjet printing device including the method and apparatus is also disclosed. Further characteristics and features of the method and apparatus are described herein, as are examples of various alternative embodiments.

16 Claims, 6 Drawing Sheets

U.S. PATENT DOCUMENTS

| | | | | |
|---|---|---|---|---|
| 5,500,668 | A | 3/1996 | Malhotra et al. | 347/105 |
| 5,517,214 | A | 5/1996 | Bhatia et al. | 347/102 |
| 5,563,644 | A | 10/1996 | Isganitis et al. | 347/102 |
| 5,574,485 | A | 11/1996 | Anderson et al. | 347/27 |
| 5,576,822 | A | 11/1996 | Lindblad et al. | 399/354 |
| 5,608,439 | A | 3/1997 | Arbeiter et al. | 347/102 |
| 5,631,685 | A | 5/1997 | Gooray et al. | 347/102 |
| 5,677,577 | A | 10/1997 | Barbehenn et al. | 307/98 |
| 5,745,145 | A | 4/1998 | Hirabayashi et al. | 347/183 |
| 5,757,396 | A | 5/1998 | Bruner | 347/27 |
| 5,766,327 | A | 6/1998 | Maze | 156/73.3 |
| 5,771,054 | A | 6/1998 | Dudek et al. | 347/102 |
| 5,774,136 | A | 6/1998 | Barbehenn et al. | 307/98 |
| 5,814,138 | A | 9/1998 | Fague | 106/31.43 |
| 5,864,741 | A | 1/1999 | Montfort et al. | 399/349 |
| 6,042,209 | A | 3/2000 | Hawkins et al. | 347/6 |
| 6,053,595 | A | 4/2000 | Otsuka et al. | 347/9 |
| 6,203,151 | B1 * | 3/2001 | Ruhe | 347/102 |

* cited by examiner

APPARATUS AND METHOD USING ULTRASONIC ENERGY TO FIX INK TO PRINT MEDIA

This is a continuation application of co-pending U.S. patent application Ser. No. 09/327,701 filed on Jun. 8, 1999.

BACKGROUND AND SUMMARY

The present invention relates to inkjet printing devices. More particularly, the present invention relates to an apparatus and method of using ultrasonic energy to fix ink to print media.

Inkjet printing devices use ink to print text, graphics, images, etc. onto print media. Inkjet printers may use print cartridges, also known as "pens", which shoot drops of ink onto a print medium, such as paper or transparencies. Each pen has a printhead that includes a plurality of nozzles. Each nozzle has an orifice through which the ink drops are fired. To print an image, the printhead is propelled back and forth across the page by, for example, a carriage, while shooting drops of ink in a desired pattern as the printhead moves. The particular ink ejection mechanism within the printhead may take on a variety of different forms known to those skilled in the art, such as thermal printhead technology. For thermal printheads, the ink may be a liquid, where dissolved colorants or pigments are dispersed in a solvent.

In a current thermal system, a barrier layer containing ink channels and vaporization chambers is located between an orifice plate and a substrate layer. This substrate layer typically contains linear arrays of heating elements, such as resistors, which are energized to heat ink within the vaporization chambers. Upon heating, the ink in the vaporization chamber turns into a gaseous state and forces or ejects an ink drop from a orifice associated with the energized resistor. By selectively energizing the resistors as the printhead moves across the print medium, the ink is expelled in a pattern onto the print medium to form a desired image (e.g., picture, chart or text).

In order for the image to be fixed to the print media so that it will not smear, the ink must be dried. The ink is dried by a combination of the solvent evaporating and the solvent absorbing into the print medium, both of which take time. Various factors control the amount of time required for a particular ink to dry. These factors include the type of print media, the quantity of solvent in an ink, the amount of ink on the print media, and ambient temperature and humidity. Ideally, the ink will be fixed to the print medium quickly to help prevent image smear, print media cockle (print media buckle toward a printhead), and print media curl (curling along at least one edge of a print media), as well as to help maximize printing device throughput.

To reduce the amount of this time, the surface of some types of print media may be specially coated to help speed drying. Other means may also be used such as special chemicals, generally know as "fixers", that are applied to print media before or after printing. Various types of heating devices may also be used to heat print media before and/or after printing. Pressure may also be applied, alone or in combination with heat from a heating device, to help reduce this amount of time.

Each of these above-described techniques have certain disadvantages. For example, specially coated print media may be relatively more expensive than uncoated print media. Fixers may become depleted during printing, resulting in no fixer being applied for the remainder of a print job, possibly causing some or all of the aforementioned problems, or the stopping of a print job to supply additional fixer, resulting in decreased printing device throughput and possible color hue shift on the print medium for which printing was halted.

Heating devices often must be warmed-up to an operating temperature which reduces initial printing device throughput. Some heating devices also require heat shielding or heat absorbing members to protect various components of a printing device from excess heat and to help dissipate heat which adds to the overall cost, size, and complexity of the printing device. In addition, such heating devices often are thermally inefficient, requiring and wasting large amounts of energy which adds to the cost of operating a printing device.

Pressure generating devices, such as pressure rollers, can cause image smear. Also, pressure generating devices add to the overall cost, size and complexity of the printing device.

An apparatus and method that decreased the amount of time required to fix ink to a print medium while avoiding the above-described problems associated with other techniques would be a welcome improvement. Accordingly, the present invention is directed to fixing ink to a print medium quickly to help prevent image smear, print media cockle, and print media curl. The present invention is also directed to helping maximize printing device throughput and minimize excessive heat generation so that the above-described heat shielding and heat absorbing members are unnecessary, thereby avoiding the above-described problems associated with such devices. The present invention is further directed to eliminating the need for pressure generating devices to help fix ink to print media, thereby also avoiding the above-noted problems associated with such devices.

An embodiment of an inkjet printing method of fixing ink to a print medium in accordance with the present invention comprises depositing ink drops on a print medium with an inkjet printhead, the ink including a solvent and the print medium including a first surface. The method additionally includes vibrating the print medium by applying ultrasonic energy to displace drops of the solvent to the first surface of the print medium to accelerate evaporation of the drops of solvent.

The above-described embodiment of a method of the present invention may be modified and include the following characteristics described below. The inkjet printing method may further comprise reducing a size of the drops of ink solvent with ultrasonic energy to accelerate evaporation of the drops of solvent. The inkjet printing method may further comprise heating the drops of ink solvent with ultrasonic energy to accelerate evaporation of the drops of solvent.

Vibrating the print medium with ultrasonic energy may include contacting the print medium. The ultrasonic energy may be applied over a predefined period of time. A fixed intensity of ultrasonic energy may be applied. A predetermined quantity of ultrasonic energy may be applied. Alternatively, a variable quantity of ultrasonic energy may be applied.

The inkjet printing method may further comprise adjusting a quantity of ultrasonic energy applied based on at least one of the following: ambient temperature, ambient humidity, print medium type, ink dry time, or an amount of ink deposited on the print medium.

An embodiment of an apparatus in accordance with the present invention for use in an inkjet printing device, the inkjet printing device configured to deposit ink on a print medium, the ink including a solvent and the print medium including a first surface, comprises an ultrasonic source configured to apply ultrasonic energy to the print medium to displace drops of the solvent to the first surface of the print medium thereby accelerating evaporation of the drops of solvent.

The above-described embodiment of an apparatus of the present invention may be modified and include the following characteristics described below. The ultrasonic source may be configured to apply ultrasonic energy to the drops of solvent to reduce a size of the drops of solvent thereby accelerating evaporation of the drops of solvent. The ultrasonic source may be configured to apply ultrasonic energy to the drops of solvent to heat the drops of solvent thereby accelerating evaporation of the drops of solvent.

The apparatus may further comprise a controller coupled to the ultrasonic source and configured to regulate the ultrasonic source thereby controlling application of the ultrasonic energy. The controller may be configured to regulate the ultrasonic source to apply ultrasonic energy over a predefined period of time. The controller may be configured to regulate the ultrasonic source to apply a fixed intensity of ultrasonic energy. The controller may be configured to regulate the ultrasonic source to apply a predetermined quantity of ultrasonic energy. The controller may be configured to regulate the ultrasonic source to apply a variable quantity of ultrasonic energy.

The apparatus may further comprise an ambient sensor coupled to the controller. In such cases, the controller is configured to utilize data from the ambient sensor to regulate the ultrasonic source.

The apparatus may further comprise a print medium sensor coupled to the controller. In such cases, the controller is configured to utilize data from the print medium sensor to regulate the ultrasonic source.

The apparatus may further comprise an ink dry-time sensor coupled to the controller. In such cases, the controller is configured to utilize data from the ink dry-time sensor to regulate the ultrasonic source.

The ultrasonic source may be positioned to contact the print medium. The apparatus may be used in a printing device.

An alternative embodiment of an apparatus in accordance with the present invention for use in an inkjet printing device, the inkjet printing device configured to deposit a ink on a print medium, the ink including a solvent and the print medium including a first surface, comprises structure for fixing ink deposited on the print medium by vibrating the print medium with ultrasonic energy to displace drops of solvent to the first surface of the print medium to accelerate evaporation of the drops of solvent. The apparatus additionally comprises structure for controlling the structure for fixing to regulate application of the ultrasonic energy.

The above-described alternative embodiment of an apparatus of the present invention may be modified and include the following characteristics described below. The structure for fixing may be configured to reduce a size of the drops of solvent to accelerate evaporation of the drops of solvent. The structure for fixing may be configured to heat the drops of solvent to accelerate evaporation of the drops of solvent.

The apparatus may further comprise structure for sensing an ambient condition and transmitting data representative of this sensed ambient condition to the structure for controlling. In such cases, the structure for controlling is configured to utilize this data to regulate the structure for fixing.

The apparatus may further comprise structure for sensing print medium type and transmitting data representative of this sensed print medium type to the structure for controlling. In such cases, the structure for controlling is configured to utilize this data to regulate the structure for fixing.

The apparatus may be used in a printing device.

Other objects, advantages, and novel features of the present invention will become apparent from the following detailed description of the invention when considered in conjunction with the accompanying drawings.

DETAILED DESCRIPTION OF THE DRAWINGS

Figure 1:
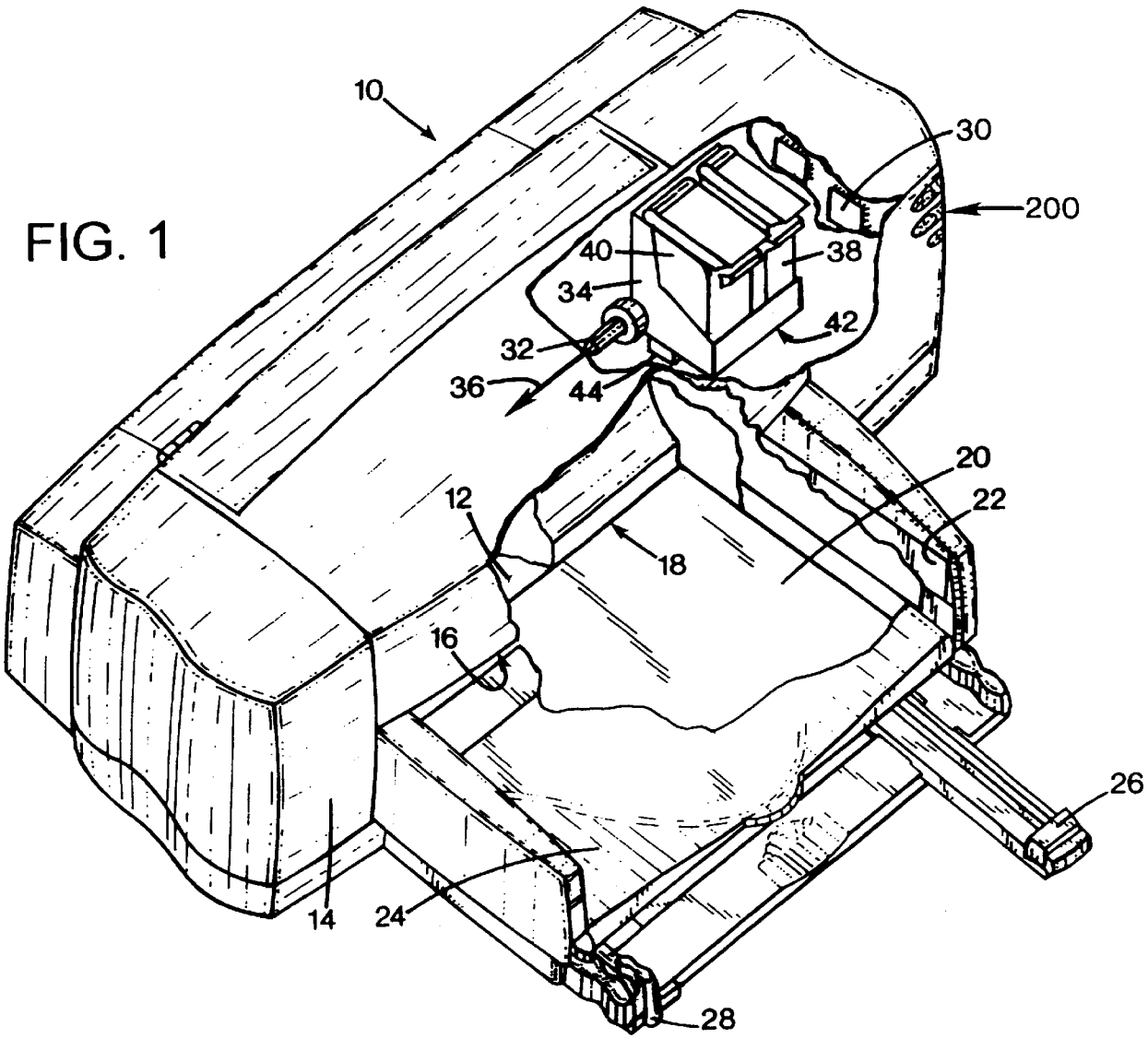
FIG. 1 is a front perspective view of an inkjet printing device that includes an embodiment of the present invention.

FIG. 1 illustrates an embodiment of an inkjet printing device 10, which may be used for printing business reports, correspondence, desktop publishing, and the like, in an industrial, office, home or other environment. A variety of inkjet printing devices are commercially available. For instance, some of the inkjet printing devices that may embody the present invention, described below, include plotters, portable printing units, copiers, cameras, video printers, and facsimile machines, to name a few. For convenience, the concepts of the present invention are illustrated in the environment of inkjet printer 10. It is to be understood, however, that the present invention may be used in other inkjet printing devices as well, such as those described above.

While it is apparent that inkjet printing device components may vary from model to model, a typical inkjet printer 10 includes a chassis 12 surrounded by a housing or casing enclosure 14, typically made of a plastic material. Sheets of print media (not shown FIG. 1) are fed through a print zone 16 by a print media handling system 18. The print media may be any type of suitable sheet material, such as letter quality paper, card stock, envelopes, photographic print stock, transparencies, and cloth. Print media handling system 18 has an input feed tray 20 for storing sheets of print media before printing. A series of conventional motor-driven print media drive rollers (not shown in FIG. 1) may be used to move the print media from tray 20 into print zone 16 for printing. After printing, the sheet then lands on a pair of retractable output drying wing members 22, only one of which is shown in FIG. 1, in a retracted position. Wings 22 momentarily hold the newly printed sheet above any previously printed sheets still drying in output tray portion 24 before pivotally retracting to the sides to drop the newly printed sheet into output tray 24. Print media handling system 18 may include a series of adjustment mechanisms for accommodating different sizes of print media, including letter, legal, A-4, envelopes, etc., such as a sliding length adjustment lever 26, and a sliding width adjustment lever 28.

Although not shown, it is to be understood that print media handling system 18 may also include other items such as one or more additional print media feed trays. Additionally, print media handling system 18 and inkjet printing device 10 may be configured to support specific printing tasks such as duplex printing (i.e., printing on both sides of a sheet of print media) and banner printing.

Inkjet printing device 10 also has a printer controller, illustrated schematically as a microprocessor 30, that receives instructions from a host device, typically a computer, such as a personal computer (not shown). Many of the printer controller functions may be performed by the host computer, by electronics on board the printer, or by interactions between the two. A monitor (not shown) coupled to the computer host may be used to display visual information to an operator, such as the printer status or a particular program being run on the host computer. Personal computers, their input devices, such as a keyboard and/or a mouse, and monitors are well known to those skilled at the art.

A carriage guide rod 32 is supported by chassis 12 to slideably support an inkjet carriage 34 for travel back and forth across print zone 16 along a scanning axis 36 defined by guide rod 32. A conventional carriage propulsion system (not shown) may be used to drive carriage 34. This conventional carriage propulsion system includes a positional feedback system which communicates carriage position signals to controller 30. An example of such a carriage propulsion system is a carriage drive gear and DC motor assembly that is coupled to drive an endless belt secured in a conventional manner to carriage 34, with the motor operating in response to controls signals received from printer controller 30. To provide carriage positional feedback information to printer controller 30, an optical encoder reader may be mounted to carriage 34 to read an encoder strip extending along the path of carriage travel.

In print zone 16, the print media sheet receives ink from an ink cartridge, such as black ink cartridge 38 and/or color ink cartridge 40 which are parts of the printing mechanism of inkjet printing device 10. Cartridges 38 and 40 are often called "pens" by those skilled in the art. The illustrated color pen 40 is a tri-color pen, although in some embodiments, a set of discreet monochrome pens may be used.

The illustrated pens 38 and 40 each include reservoirs for storing a supply of ink. Pens 38 and 40 have printheads 42 and 44, respectively, each of which has an orifice plate with plurality of nozzles formed therethrough in manner well known to those skilled in the art. The illustrated printheads 42 and 44 are thermal inkjet printheads, although other types of printheads may be used, such as piezoelectric printheads. Printheads 42 and 44 typically include a substrate layer having a plurality of resistors which are associated with the nozzles. Upon energizing a selected resistor, a bubble of gas is formed to eject a droplet of ink from the nozzle onto print media in print zone 16. The printhead resistors are selectively energized in response to enabling or firing command control signals, which may be delivered by a conventional multi-conductor strip (not shown) from controller 30 to printhead carriage 34, and through conventional interconnects between carriage 34 and pens 38 and 40 to printheads 42 and 44.

In order for the image to be fixed to the print media so that it will not smear, the ink must be dried. The ink is dried by a combination of the solvent evaporating and the solvent absorbing into the print medium, both of which take time. Various factors control the amount of time required for a particular ink to dry. These factors include the type of print media, the quantity of solvent in an ink, the amount of ink on the print media, and ambient temperature and humidity. Ideally, the ink will be fixed to the print medium quickly to help prevent image smear, print media cockle (print media buckle toward a printhead), and print media curl (curling along at least one edge of a print media), as well as help maximize printing device throughput.

To reduce the amount of this time, the surface of some types of print media may be specially coated to help speed drying. Other means may also be used such as special chemicals, generally know as "fixers", that are applied to print media before or after printing. Various types of heating devices may also be used to heat print media before and/or after printing. Pressure may also be applied, alone or in combination with heat from a heating device, to help reduce this amount of time.

Each of these above-described techniques have certain disadvantages. For example, specially coated print media may be relatively more expensive than uncoated print media. Fixers may become depleted during printing, resulting in no fixer being applied for the remainder of a print job, possibly causing some or all of the aforementioned problems, or the stopping of a print job to supply additional fixer, resulting in decreased printing device throughput and possible color hue shift on the print medium for which printing was halted.

Heating devices often must be warmed-up to an operating temperature which reduces initial printing device throughput. Some heating devices also require heat shielding or heat absorbing members to protect various components of a printing device from excess heat and to help dissipate heat which adds to the overall cost, size, and complexity of the printing device. In addition, such heating devices often are thermally inefficient, requiring and wasting large amounts of energy which adds to the cost of operating a printing device.

Pressure generating devices, such as pressure rollers, can cause image smear. Also, pressure generating devices add to the overall cost, size and complexity of the printing device.

An apparatus and method that decreased the amount of time required to fix ink to a print medium while avoiding the above-described problems associated with other techniques would be a welcome improvement. Accordingly, the present invention is directed to fixing ink to a print medium quickly to help prevent image smear, print media cockle, and print media curl. The present invention is also directed to helping maximize printing device throughput and minimize excessive heat generation so that the above-described heat shielding and heat absorbing members are unnecessary, thereby avoiding the above-noted problems associated with such devices. The present invention is further directed to eliminating the need for pressure generating devices to help fix ink to print media, thereby also avoiding the above-noted problems associated with such devices.

Figure 2:
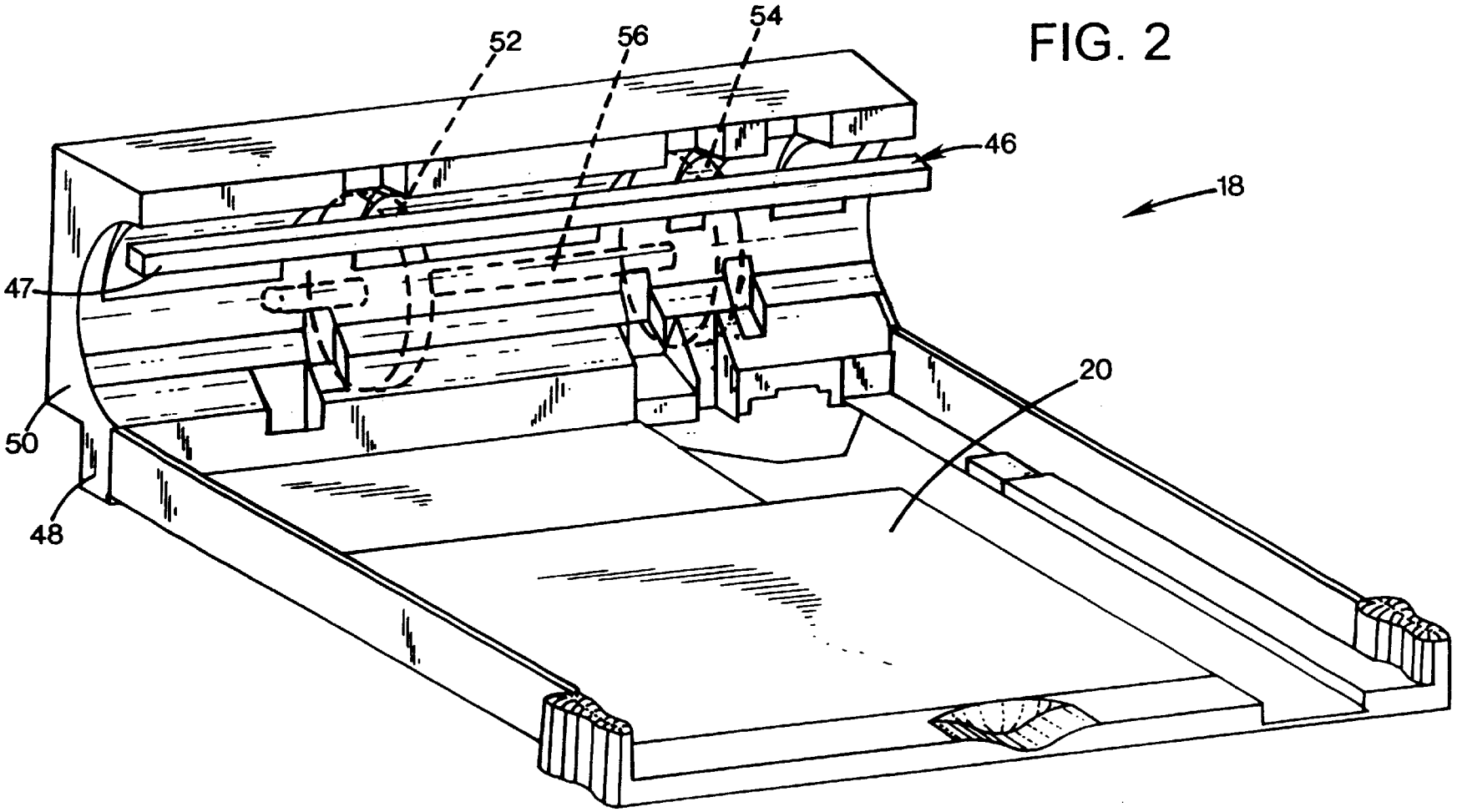
FIG. 2 is a perspective view of a print media handling system and an embodiment of an ultrasonic source of the present invention.

A perspective view of print media handling system 18 and an embodiment of an ultrasonic source 46 of the present invention are shown in FIG. 2. Ultrasonic source 46 is configured to apply ultrasonic energy to ink deposited on a print medium (not shown in FIG. 2) by pens 38 and 40 to fix the ink to the print medium, as more fully discussed below. As can be seen in FIG. 2, ultrasonic source 46 includes a substantially rectangular bar 47 that extends across substantially the entire width of print zone 16 (see FIG. 1) such that substantially the entire width of a sheet of print media receives ultrasonic energy from source 46, as also more fully discussed below. It should be noted that the use of the word substantially in this document is used to account for things such as engineering and manufacturing tolerances, as well as variations not affecting performance of the present invention.

As can be seen FIG. 2, print media handling system 18 includes a lower print media guide 48 and an upper print media guide 50. Print media handling system 18 also includes a pair of print media drive rollers 52 and 54 positioned adjacent lower and upper print media guides 48 and 50 and driven by a print media drive roller shaft 56. Shaft 56 is coupled to and driven by a motor, which is not shown FIG. 2.

Figure 3:
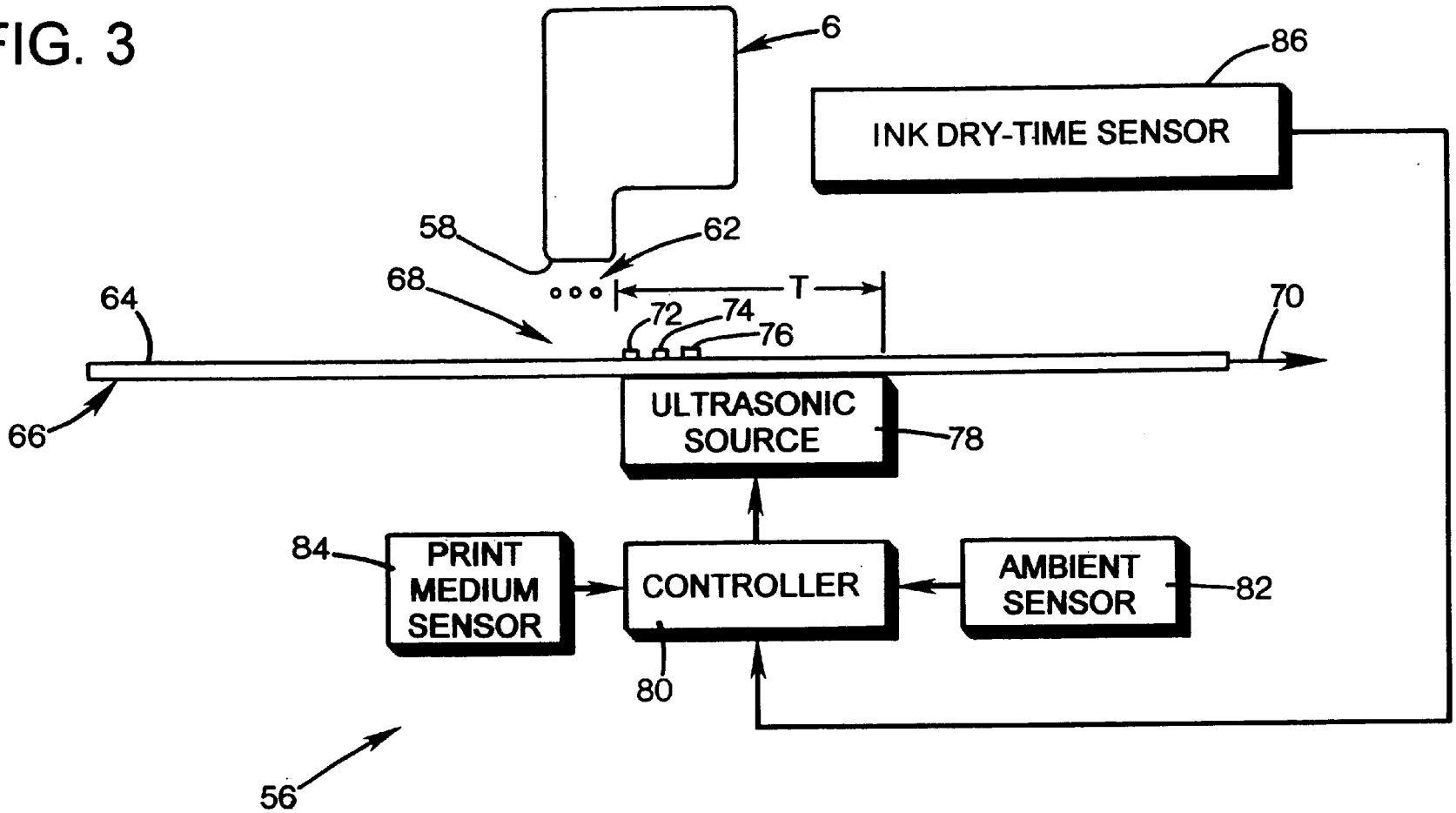
FIG. 3 is a diagram of an embodiment of an apparatus in accordance with the present invention in use in an inkjet printing device.

In operation, print media drive rollers 52 and 54 select or "pick" a sheet of print media in feed tray 20 and transport the sheet of print media to print zone 16 for printing by cartridges 38 and 40 of the printing mechanism of inkjet printing device 10. During this transport, the sheet of print media moves between rollers 52 and 54 and upper and lower print media guides 48 and 50. Subsequent to printing, the sheet of print media passes over ultrasonic source 46, as shown in FIGS. 3 and 4 and discussed more fully below.

Ultrasonic source 46 may generate ultrasonic energy in a variety of ways, such as piezoelectric crystal vibration, semiconductor vibration, polycrystal ferrimagnet vibration, polycrystal ferromagnetic vibration, and speaker vibration. As used herein, ultrasonic is specifically defined as vibrations substantially above a frequency of 20,000 Hertz.

Ultrasonic sources in accordance with the present invention, including ultrasonic source 46, may include concentrators that are configured to focus ultrasonic energy generated by an ultrasonic source into a specific area. This area may be fixed in position or repositionable. Such focusing of ultrasonic energy helps to reduce energy waste and further speed fixing of ink to a print medium A diagram of an embodiment of an apparatus 56 in accordance with the present invention in use in an inkjet printing device, such as inkjet printing device 10, is shown in FIG. 3. As can be seen in FIG. 3, an ink cartridge printhead 58 of an ink cartridge 60 is shown depositing ink 62 onto a first surface 64 of a print medium 66, as print medium 66 is transported through a print zone 68 by a print media handling system (not shown). This movement of print medium 66 is generally indicated by arrow 70. Subsequent to such deposition, both print medium 66 and ink 72, 74, and 76 pass over source of ultrasonic energy 78. In the embodiment of the present invention shown in FIG. 3, source of ultrasonic energy 78 is in contact with print medium 66 during a time period or duration (T) which is defined by both the dimensions of source 78 and rate at which the print media handling system of the inkjet printing device moves print medium 66.

Figure 4:
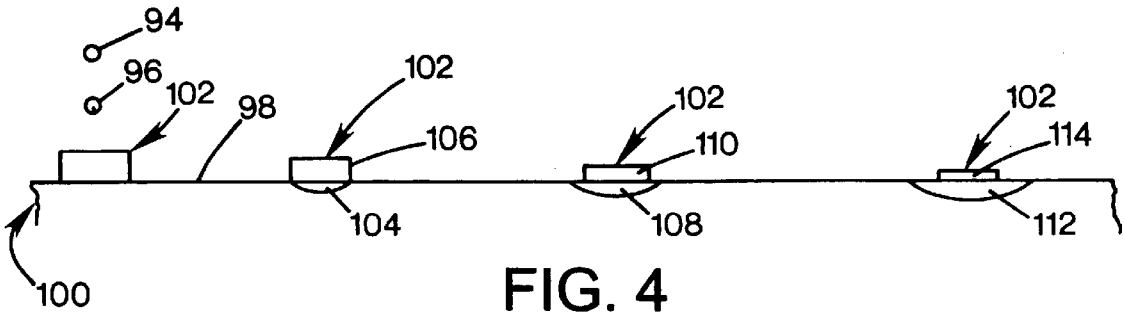
FIG. 4 is a diagram of ink fixing to a print medium by absorbing into the print medium.

As can be seen in FIG. 4, ink drops 94 and 96 are deposited on first surface 98 of print medium 100, for example by ink cartridge 58 and/or ink cartridge 60, and collect to form ink 102. As can also be seen in FIG. 4, subsequent to such deposition of drops 94 and 96, ink 102 begins to fix to print medium 100 by a first quantity 104 absorbing into print medium 100, while a second quantity 106 remains at first surface 98. Over time, a greater first quantity of ink 108 absorbs into print medium 100, while a smaller second quantity 110 remains at first surface 98. Over still more time, an even greater quantity of ink 112 absorbs into print medium 100 while an even smaller second quantity 114 remains at first surface 98. At some point, further absorption into print medium 100 ceases and ink 102 is fixed to print medium 100.

One problem associated with absorption of ink 102 into print medium 100, as shown in FIG. 4, is that much of the solvent in the ink is absorbed into print medium 100 and remains there, rather than being evaporated. As such, contact between ink 102 and additional liquid from external sources can cause a variety of problems, including ink 102 smear on first surface 98, ink 102 bleed-through to the second surface (not shown) of print medium 100, and degradation of print medium 100 due to an inability to absorb additional liquid. Another problem is the time required for such absorption to occur. This problem is often addressed through the use of specially treated print media, fixers, heating devices, and/or pressure generating devices. As discussed above, problems exist with each of these techniques.

Figure 5A:
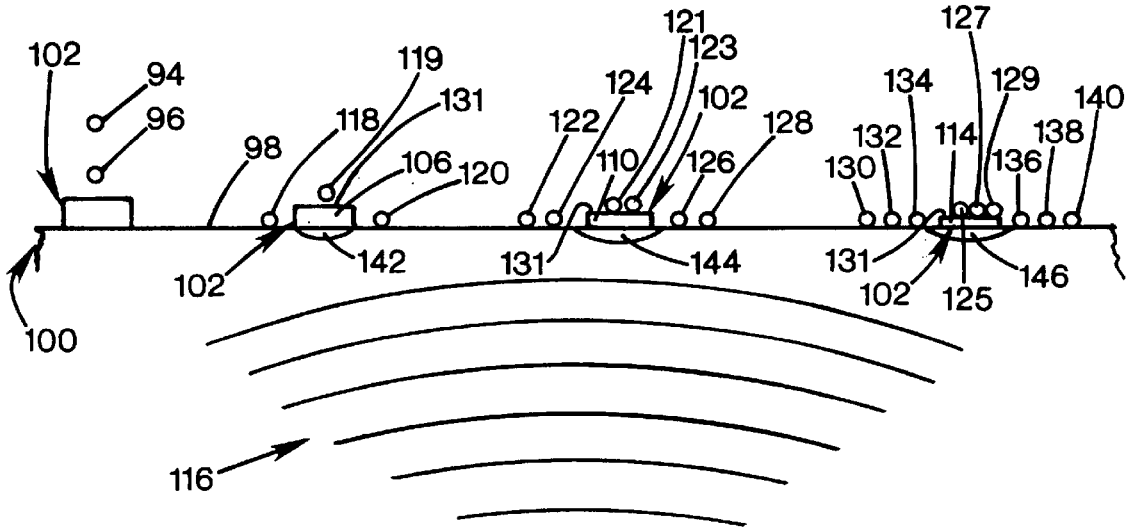
FIGS. 5A, 5B, and 5C are diagrams illustrating operation of the present invention in fixing ink to a print medium.

As discussed above, sources of ultrasonic energy in accordance with the present invention are configured to apply ultrasonic energy to ink deposited on a print medium to fix the ink to the print medium while avoiding the problems associated with these above-described techniques. In operation of the present invention, as shown in FIG. 5A, ultrasonic energy 116 from an ultrasonic source in accordance with the present invention vibrates print medium 100 which displaces drops of solvent 118, 120, 122, 124, 126, 128, 130, 132, 134, 136, 138, and 140 in ink 102 from print medium 100 to first surface 98 to accelerate evaporation of the drops of solvent, thereby reducing the amount of time required to fix ink 102 to print medium 100. As can be seen in FIG. 5A, displacement of drops of solvent 118, 120, 122, 124, 126, 128, 130, 132, 134, 136, 138, and 140 to first surface 98 of print medium 100 reduces the quantity of solvent 142, 144, and 146 in print medium 100 relative to respective quantities 104, 108, and 112 that occur in the absence of the present invention. Ultrasonic energy 116 also displaces drops of solvent 119, 121, 123, 125, 127, and 129 in ink 102 to first surface 131 to further accelerate evaporation of the drops of solvent, thereby reducing the amount of time required to fix ink 102 to print medium 100.

Figure 5B:
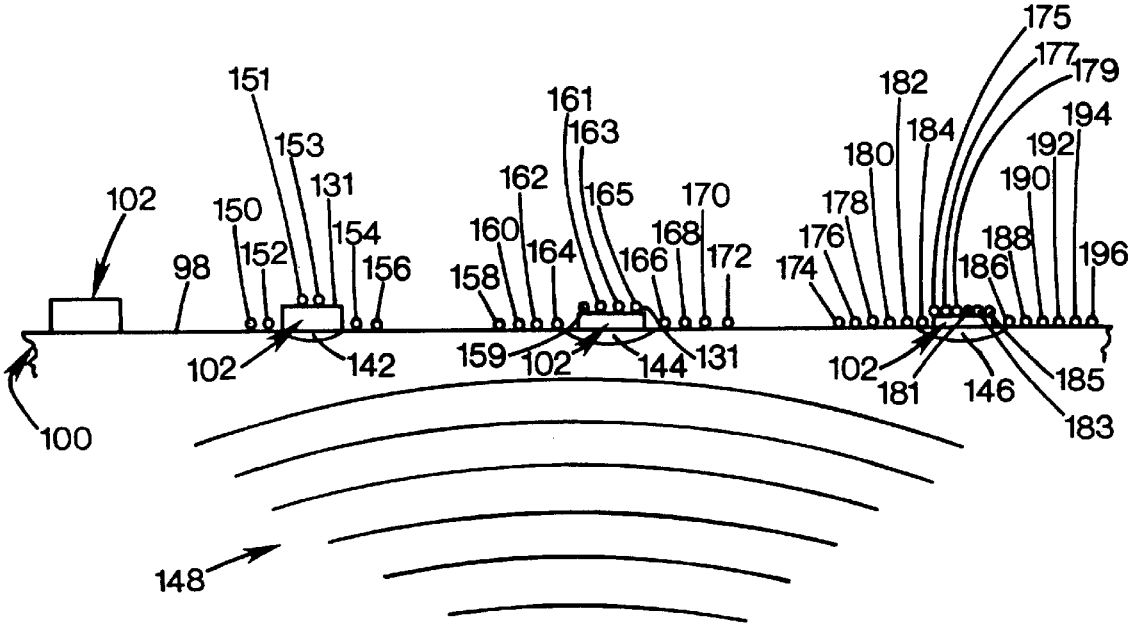

At first surface 98, additional ultrasonic energy 148 reduces the size of drops of solvent 118, 119, 120, 121, 122, 123, 124, 125, 126, 127, 128, 129, 130, 132, 134, 136, 138, and 140 to form smaller drops of solvent 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196, as shown in FIG. 5B, which further accelerates evaporation of the solvent due to increased solvent drop surface area, thereby reducing the amount of time required to fix ink 102 to print medium 100.

For example, if drops of solvent 118, 119, 120, 121, 122, 123, 124, 125, 126, 127, 128, 129, 130, 132, 134, 136, 138, and 140 are substantially spherical and resulting drops of solvent 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196 are also substantially spherical and are each half the volume of drops of solvent 118, 119, 120, 121, 122, 123, 124, 125, 126, 127, 128, 129, 130, 132, 134, 136, 138, and 140, then the volumes and surface areas of these drops of solvent can be approximated from the following equations:

$$\text{Volume}=(4/3)(\Pi)r^3, \text{ where r is the radius of a sphere; and}$$

$$\text{Surface Area}=4(\Pi)r^2, \text{ where r is the radius of a sphere.}$$

If the radius of each of drops 118, 119, 120, 121, 122, 123, 124, 125, 126, 127, 128, 129, 130, 132, 134, 136, 138, and 140 is one (1), then the radius of each of drops 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196 is approximately (0.794) because the volume of each of drops 150, 151, 152, 153, 154, 156, 158, 159, 160, 161, 162, 163, 164,

165, 166, 168, 170, 172, 174, 175, 176, 177, 178, 179, 180, 181, 182, 183, 184, 185, 186, 188, 190, 192, 194, and 196 (Volume=$(4/3)(\Pi)(0.794)^3=0.667\Pi$) is half the volume of each of drops 118, 119, 120, 121, 122, 123, 124, 125, 126, 127, 128, 129, 130, 132, 134, 136, 138, and 140 (Volume=$(4/3)(\Pi)(1)^3=1.340\Pi$).

This means that each drop 118, 119, 120, 121, 122, 123, 124, 125, 126, 127, 128, 129, 130, 132, 134, 136, 138, and 140 has a surface area of (Surface Area=$4(\Pi)(1)^2=4\Pi$) whereas each drop 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196 has a surface area of (Surface Area=$4(\Pi)(0.794)^2=2.522\Pi$). The total surface area of drops of solvent 118, 119, 120, 121, 122, 123, 124, 125, 126, 127, 128, 129, 130, 132, 134, 136, 138, and 140 is thus the total number of these drops multiplied by the surface area of each drop, or: $(18\times4\Pi)=72\Pi$. The total surface area of drops of solvent 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196 is also the total number of these drops multiplied by the surface area of each drop, or: $(36\times2.522\Pi)=90.792\Pi$. This represents a total surface area percent increase as a result of application of additional ultrasonic energy 148 of:

$$\text{Percent increase in total surface area}=90.792\Pi-72\Pi\times100\%=26.088\%$$

Figure 5C:
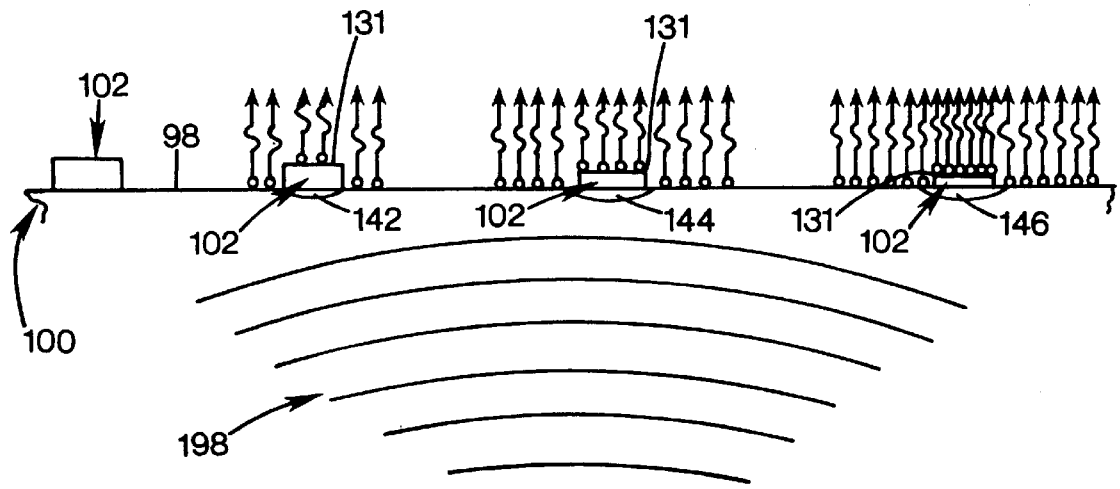

At first surfaces 98 and 131, further ultrasonic energy 198 heats drops of solvent 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196, as shown in FIG. 5C, which further accelerates evaporation, as generally indicated by the arrows above each of drops 150, 151, 152, 153, 154, 156, 158, 159, 160, 161, 162, 163, 164, 165, 166, 168, 170, 172, 174, 175, 176, 177, 178, 179, 180, 181, 182, 183, 184, 185, 186, 188, 190, 192, 194, and 196, thereby reducing the amount of time required to fix ink 102 to print medium 100.

Referring again to FIG. 3, apparatus 56 also includes controller 80 coupled to ultrasonic source 78 and configured regulate ultrasonic source 78, thereby controlling application of ultrasonic energy ink 72, 74, and 76. Controller 80 is separate from controller 30, but, in other embodiments of the present invention, the functions performed by controller 80 may be incorporated in controller 30 instead, eliminating the need for controller 80 altogether.

As can further be seen in FIG. 3, apparatus 56 additionally includes an ambient sensor 82, a print medium sensor 84, and a ink dry-time sensor 86 each of which is coupled to controller 80 to transmit data to controller 80. Ambient sensor 82 can be an ambient temperature sensor, an ambient humidity sensor, or both. Ambient sensor 82 is configured to measure such ambient temperature and/or humidity conditions in the area of print zone 68. Print medium sensor 84 is configured to determine the type of print medium, for example paper or transparency, present in print zone 68. Ink dry-time sensor 86 is configured to measure the amount of time required for a particular ink to be fixed to print medium 66. Although apparatus 56 is shown with the combination of ambient sensor 82, print medium sensor 84, and ink dry-time sensor 86, it is to be understood that in other embodiments of the present invention, one or more of these sensors need not be present.

Controller 80 is configured to utilize data from sensors 82, 84, and 86 to further regulate application of ultrasonic energy to ink 72, 74, and 76. For example, humidity data from ambient sensor 82 can be used by controller 80 to regulate the quantity of ultrasonic energy that is applied by ultrasonic source 78 to ink 72, 74, and 76. For high humidity conditions, a greater quantity of ultrasonic energy is required than for lower humidity conditions due to increased moisture in the area of print zone 68 some of which is absorbed by print medium 66. As another example, print medium data from print medium sensor 84 regarding the type of print medium in print zone 68 can be used by controller 80 to regulate the quantity of ultrasonic energy that is applied by ultrasonic source 78 to ink 72, 74, and 76. Different quantities of ultrasonic energy may be required depending on the type of print medium in print zone 68. As a further example, ink dry-time data from ink dry-time sensor 86 regarding the amount of time required for a particular ink to be fixed to print medium 66 can be used by controller 80 to regulate the quantity of ultrasonic energy that is applied by ultrasonic source 78 to ink 72, 74, and 76.

There are a variety of ways in which controller 80 may be configured to regulate application of ultrasonic energy to ink 72, 74, and 76. The regulation of the application of this ultrasonic energy includes both the intensity of the applied ultrasonic energy and the duration of time that a given intensity is applied. Both of these determine the total quantity of ultrasonic energy that is applied. Controller 80 may be configured to regulate a predetermined quantity of ultrasonic energy or a variable quantity, based on data transmitted to controller 80 by one or more of the above-described sensors 82, 84, and 86 or based on data from a user of inkjet printing device 10 entered through keypad 200 (see FIG. 1).

A predetermined quantity of ultrasonic energy includes applying a fixed intensity of ultrasonic energy to ink 72, 74, and 76 over a fixed or predefined period of time. A variable quantity of ultrasonic energy may include a fixed intensity of ultrasonic energy with a variable time duration, a variable intensity of ultrasonic energy with a fixed or predefined time duration, or both a variable intensity of ultrasonic energy with a variable time duration. The quantity of applied ultrasonic energy may also be controlled by varying the frequency of the applied ultrasonic energy by means such as controller 80. The duration of applied ultrasonic energy may be regulated by controller 80 varying the speed at which print medium 66 is advanced by print media handing system 18, varying the amount of time ultrasonic source 78 is energized, or by a combination of these two techniques. As noted above, data from one or more of sensors 82, 84, and 86 may be used by controller 80 to regulate the variable intensity and/or variable time duration.

Figure 6:
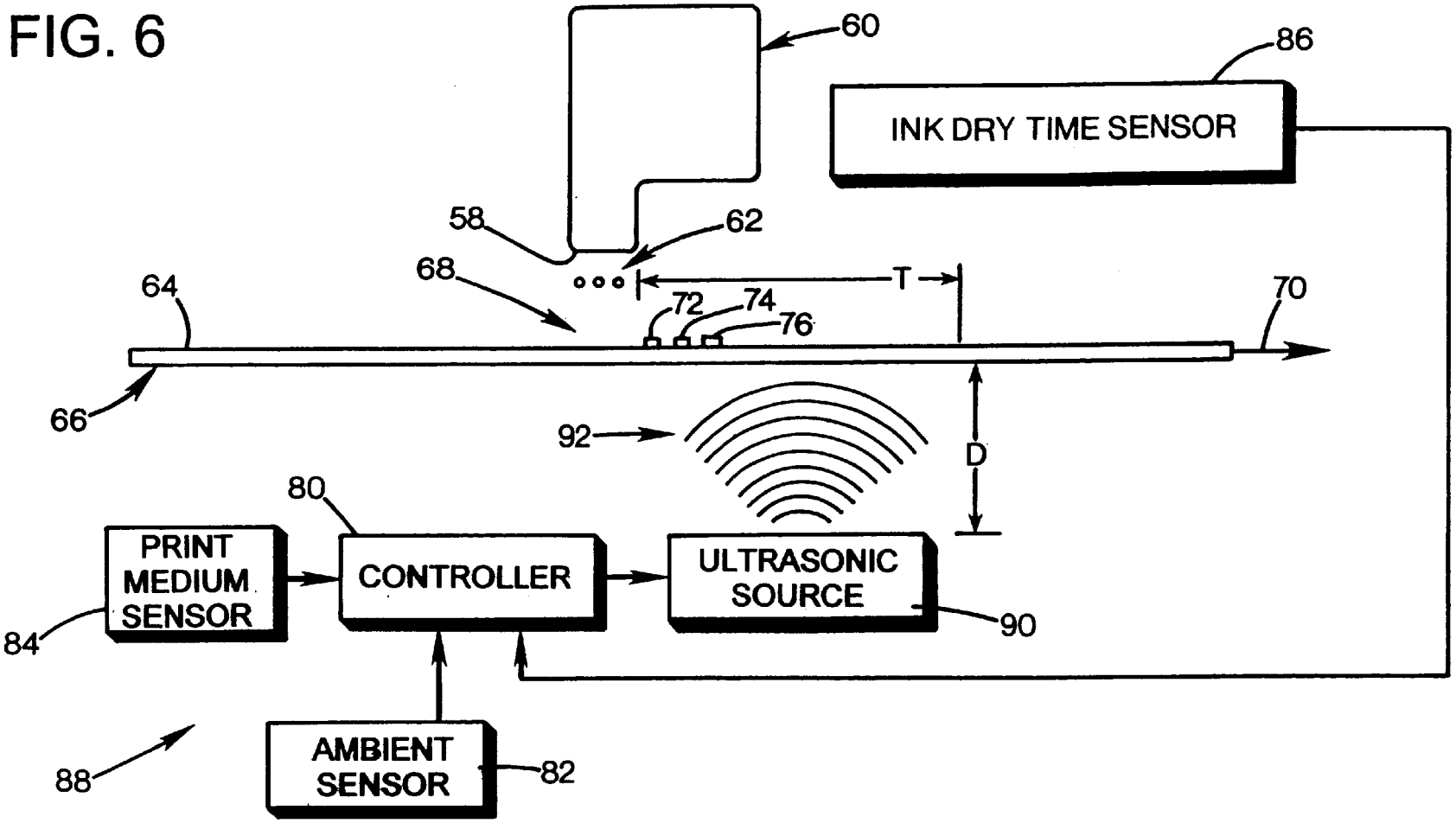
FIG. 6 is a diagram of an alternative embodiment of an apparatus in accordance with the present invention in use in an inkjet printing device.

A diagram of an alternative embodiment of an apparatus 88 in accordance with the present invention in use in an inkjet printing device, such as inkjet printing device 10, is shown in FIG. 6. As can be seen in FIG. 6, identical reference numerals to those for apparatus 56 in FIG. 3 have been used where possible to refer to items that can remain the same in apparatus 88. The discussion above with respect to the configuration and functioning of these items in apparatus 56 is applicable to apparatus 88 as well, unless specifically noted otherwise below.

As can be seen in FIG. 6, apparatus 88 utilizes a different ultrasonic source 90 that is configured to apply ultrasonic energy to ink 72, 74, and 76 deposited on first surface 64 of print medium 66 to fix ink 72, 74, and 76 to print medium 66. Unlike ultrasonic source 78, ultrasonic source 90 is not in contact with print medium 66, but rather positioned adjacent print medium 66 at a predetermined distance (D). In this way, waves of ultrasonic energy 92 radiate from source 90 toward print medium 66 as shown. Waves of ultrasonic energy 92 vibrate print medium 66 which displaces drops of the solvent in the ink to first surface 64 of print medium 66, thereby reducing the amount of time required to fix ink 72, 74, and 76 to print medium 66. At first surface 64, additional ultrasonic energy reduces the size of the drops of solvent and heats these drops, as discussed above, to accelerate evaporation, thereby reducing the amount of time required to fix ink 72, 74, and 76 to print medium 66.

As noted above, ultrasonic source 90 is positioned adjacent print medium 66 at a predetermined distance (D). This distance (D) helps determine the intensity and therefore the quantity of ultrasonic energy applied to ink 72, 74, and 76. That is, for the same ultrasonic source 90, a greater distance (D) reduces the intensity of ultrasonic energy at any point on print medium 66 due to dispersion of ultrasonic energy waves 92 as they travel from source 90 to print medium 66. As discussed above, controller 80 and sensors 82, 84, and 86 also help determine the quantity of ultrasonic energy applied to ink 72, 74, and 76, as may user data supplied via keypad 200.

Although the invention has been described and illustrated in detail, it is to be clearly understood that the same is intended by way of illustration and example only, and is not to be taken necessarily, unless otherwise stated, as an express limitation. For example the print media handling system of inkjet printing device 10 can be a drum or belt that advances the print media, rather than print media drive rollers 52 and 54 of print media handling system 18, as shown. In such cases, part of the ultrasonic source could include the drum or belt. Alternatively, an ultrasonic source separate from the drum or belt could be used. As another example, in other embodiments of the present invention, ultrasonic sources of the present invention may be formed in nonrectangular shapes as well, such as substantially oval, substantially circular, substantially triangular, substantially hexagonal, etc. The spirit and scope of the present invention are to be limited only by the terms of the following claims.

What is claimed is:

1. An apparatus for use in an inkjet printing device, the inkjet printing device configured to deposit ink on a print medium, the ink including a solvent and the print medium including a first surface, the apparatus comprising:

means for fixing ink deposited on the print medium by vibrating the print medium with ultrasonic energy to displace drops of solvent to the first surface of the print medium to accelerate evaporation of the drops of solvent; and means for controlling the means for fixing to regulate application of the ultrasonic energy.

2. The apparatus of claim 1, further comprising means for sensing an ambient condition and transmitting data representative of this sensed ambient condition to the means for controlling, wherein the means for controlling is configured to utilize this data to regulate the means for fixing.

3. The apparatus of claim 1, further comprising means for sensing print medium type and transmitting data representative of this sensed print medium type to the means for controlling, wherein the means for controlling is configured to utilize this data to regulate the means for fixing.

4. A printing device comprising the apparatus as recited in claim 1.

5. An inkjet printing method of fixing ink to a print medium, the method comprising:

depositing ink drops on a print medium with an inkjet printhead, the ink including a solvent and the print medium including a first surface; and vibrating the print medium by applying ultrasonic energy to displace drops of the solvent to the first surface of the print medium to accelerate evaporation of the drops of solvent;

wherein the ultrasonic energy is applied over a predefined period of time.

6. A inkjet printing method of fixing ink to a print medium, the method comprising:

depositing ink drops on a print medium with an inkjet printhead, the ink including a solvent and the print medium including a first surface; and vibrating the print medium by applying ultrasonic energy to displace drops of the solvent to the first surface of the print medium to accelerate evaporation of the drops of solvent;

wherein a predetermined quantity of ultrasonic energy is applied.

7. An inkjet printing method of fixing ink to a print medium, the method comprising:

depositing ink drops on a print medium with an inkjet printhead, the ink including a solvent and the print medium including a first surface; and vibrating the print medium by applying ultrasonic energy to displace drops of the solvent to the first surface of the print medium to accelerate evaporation of the drops of solvent;

wherein a variable quantity of ultrasonic energy is applied.

8. An inkjet printing method of fixing ink to a print medium, the method comprising:

depositing ink drops on a print medium with an inkjet printhead, the ink including a solvent and the print medium including a first surface;

vibrating the print medium by applying ultrasonic energy to displace drops of the solvent to the first surface of the print medium to accelerate evaporation of the drops of solvent; and adjusting a quantity of ultrasonic energy applied based on at least one of the following: ambient temperature, ambient humidity, print medium type, ink dry time, and an amount of ink deposited on the print medium.

9. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent and a controller coupled to the ultrasonic source and configured to regulate the ultrasonic source thereby controlling application of the ultrasonic energy.

10. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent and a controller coupled to the ultrasonic source and configured to regulate the ultrasonic source thereby controlling application of the ultrasonic energy, wherein the controller is configured to regulate the ultrasonic source to apply ultrasonic energy over a predefined period of time.

11. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent and a controller coupled to the ultrasonic source and configured to regulate the ultrasonic source thereby controlling application of the ultrasonic energy, wherein the controller is configured to regulate the ultrasonic source to apply a fixed intensity of ultrasonic energy.

12. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent and a controller coupled to the ultrasonic source and configured to regulate the ultrasonic source thereby controlling application of the ultrasonic energy, wherein the controller is configured to regulate the ultrasonic source to apply a predetermined quantity of ultrasonic energy.

13. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent and a controller coupled to the ultrasonic source and configured to regulate an ultrasonic source thereby controlling application of the ultrasonic energy, wherein the controller is configured to regulate the ultrasonic source to apply a variable quantity of ultrasonic energy.

14. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent, a controller coupled to the ultrasonic source and configured to regulate the ultrasonic source thereby controlling application of the ultrasonic energy, and an ambient sensor coupled to the controller, wherein the controller is configured to utilize data from the ambient sensor to regulate the ultrasonic source.

15. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent, a controller coupled to the ultrasonic source and configured to regulate the ultrasonic source thereby controlling application of the ultrasonic energy, and a print medium sensor coupled to the controller, wherein the controller is configured to utilize data from the print medium sensor to regulate the ultrasonic source.

16. An apparatus for use in an inkjet printing device, the inkjet printing device configured to deposit ink on a print medium, the ink including a solvent and the print medium including a first surface, the apparatus comprising an ultrasonic source configured to apply ultrasonic energy to the print medium to displace drops of the solvent to the first surface of the print medium thereby accelerating evaporation of the drops of solvent, a controller coupled to the ultrasonic source and configured to regulate the ultrasonic source thereby controlling application of the ultrasonic energy, and an ink dry-time sensor coupled to the controller, wherein the controller is configured to utilize data from the ink dry-time sensor to regulate the ultrasonic source.

* * * * *